US008764944B2

(12) United States Patent
Kim

(10) Patent No.: US 8,764,944 B2
(45) **Date of Patent: *Jul. 1, 2014**

(54) COKE OVEN COMPRISING TERTIARY HEATING ELEMENTS IN THE GAS CHAMBER

(75) Inventor: Ronald Kim, Essen (DE)

(73) Assignee: Uhde GmbH, Dortmund (DE)

( * ) Notice: Subject to any disclaimer, the term of this patent is extended or adjusted under 35 U.S.C. 154(b) by 1114 days.

This patent is subject to a terminal disclaimer.

(21) Appl. No.: 12/311,151

(22) PCT Filed: Sep. 7, 2007

(86) PCT No.: PCT/EP2007/007812
§ 371 (c)(1),
(2), (4) Date: May 21, 2010

(87) PCT Pub. No.: WO2008/034531
PCT Pub. Date: Mar. 27, 2008

(65) Prior Publication Data

US 2010/0065413 A1 Mar. 18, 2010

(30) Foreign Application Priority Data

Sep. 21, 2006 (DE) ..... 10 2006 045 056

(51) Int. Cl.
*C10B 15/02* (2006.01)
*C10B 29/02* (2006.01)

(52) U.S. Cl.
USPC ..... 201/15; 201/18; 201/27; 202/135; 202/145; 202/223; 202/267.1

(58) Field of Classification Search
USPC ..... 202/134, 135, 145, 222, 223, 224, 202/267.1; 432/209, 247; 165/133, 904; 201/15, 18, 27
See application file for complete search history.

(56) References Cited

U.S. PATENT DOCUMENTS 4,111,757 A 9/1978 Ciarimboli
4,284,072 A * 8/1981 McKaveney ..... 165/133

(Continued)

FOREIGN PATENT DOCUMENTS

| | | | |
|---|---|---|---|
| DE | 44 02 390 | C1 | 5/1995 |
| DE | 691 06 312 | T2 | 5/1995 |
| DE | 10 2005 025 955 | B3 | 3/2007 |
| DE | 10 2005 055 483 | A1 | 5/2007 |
| EP | 0 742 276 | A1 | 11/1996 |

OTHER PUBLICATIONS

Ulrich Kochanski et al; Overview of Uhde Heat Recovery Cokemaking Technology; AISTech 2005 Proceedings, Iron and Steel Technology Conference Proceedings, Association for Iron and Steel Technology; 2005; pp. 25-32, vol. I; U.S.; XP008068124.

(Continued)

*Primary Examiner* — Jill Warden
*Assistant Examiner* — Joye L Woodard
(74) *Attorney, Agent, or Firm* — Marshall & Melhorn, LLC

(57) ABSTRACT

A coke oven of horizontal construction (non-recovery/heat recovery type) includes at least one coking chamber, laterally arranged vertical downcomers as well as bottom flues arranged horizontally and extending underneath the coking chamber for indirect reheating of said coking chamber. One or more gas space dividing walls are arranged in the oven free space which in the intended operation of the coke oven is not destined for being filled with solid matter so that the gas routing is improved and a homogenisation of radiation in the coking chamber is achieved.

11 Claims, 3 Drawing Sheets

(56) References Cited

U.S. PATENT DOCUMENTS

| | | | | |
|---|---|---|---|---|
| 4,287,024 | A | 9/1981 | Thompson | |
| 4,344,820 | A | 8/1982 | Thompson | |
| 5,114,542 | A | 5/1992 | Childress et al. | |
| 5,318,671 | A | 6/1994 | Pruitt | |
| 6,596,128 | B2 | 7/2003 | Westbrook | |
| 2009/0152092 | A1 | 6/2009 | Kim et al. | |
| 2010/0025217 | A1 | 2/2010 | Schuecker et al. | |
| 2010/0065412 | A1* | 3/2010 | Kim | 201/16 |

OTHER PUBLICATIONS

Walter E. Buss et al; Thyssen Still Otto/PACTI nonrecovery cokemaking system; Iron and Steel Engineer, Association of Iron and Steel Engineers; Jan. 1999; pp. 33-38, vol. 76, No. 1; Pittsburgh, U.S.; XP000799176.

Meinhard Schulte et al; Einsatz von Hochemissions-Coatings an Innenwaenden von Waermoefen; Stahl und Eisen; Mar. 14, 1990; pp. 99-104, vol. 110, No. 3; Duesseldorf, Germany; XP000135342.

* cited by examiner

COKE OVEN COMPRISING TERTIARY HEATING ELEMENTS IN THE GAS CHAMBER

BACKGROUND OF THE INVENTION

The invention relates to a coke oven of horizontal construction (non-recovery/heat recovery type) consisting of at least one coking chamber, laterally arranged vertical downcomers as well as bottom flues arranged horizontally and extending underneath the coking chamber for indirect reheating of said coking chamber, wherein one or more gas space dividing walls are arranged in the oven free space which in the intended operation of the coke oven is not destined for being filled with solid matter.

Coke ovens of horizontal construction are known from prior art in technology and they are in frequent use. Examples of such coke ovens are described in U.S. Pat. Nos. 4,111,757, 4,344,820, 6,596,128 B2 or DE 691 06 312 T2.

Known from prior art in technology are different approaches designed to speed up the coking time of coal and to assure a uniform advance of coal carbonisation in the coal charge or stamped coal cake.

The approach strongly pursued here was to improve gas routing in the oven room. In DE 10 2005 055483 it is proposed to automate the air feed which is accomplished through the oven doors and to control it depending on the coking time through a central drive. Even though a good controllability is thereby achieved, the problem still exists of supplying the depth of the oven room evenly with combustion air without unnecessarily increasing the burn-off in the area near the oven door too much.

DE 10 2005 025955 proposes a multiple feed of combustion air which is realised through a distribution system that is mainly arranged on the oven top. Through this distribution system, primary combustion air is conducted from above through the oven top via many openings into the oven room. This system of feeding combustion gas represents a marked improvement versus a central introduction of combustion air through openings in the oven door. Still there is a demand, however, to further improve the gas routing in the coke oven and to reduce the coking time, thereby improving the economic efficiency of this method.

BRIEF SUMMARY OF THE INVENTION

This task is solved by the coke oven of horizontal construction (non-recovery/heat recovery type) as defined in the principal claim. This coke oven consists of at least one coking chamber, laterally arranged vertical downcomers as well as bottom flues arranged horizontally and extending underneath the coking chamber for indirect reheating of said coking chamber, wherein one or more gas space dividing walls are arranged in the oven free space which in the intended operation of the coke oven is not destined for being filled with solid matter.

The gas space dividing walls may have any form and are ideally shaped as hanging ribs or hanging walls, which can be further improved to have openings or a partly open structure.

In principle the gas space dividing walls can be fastened in any kind in the oven chamber. Ideally the gas space dividing walls are detachably hung into suitable holders, with these holders being mounted in the wall and/or top of the coking chamber. On the one hand it has the advantage that the gas space dividing walls can be taken out more easily when work is to be done on a coke oven chamber, and on the other hand it is avoided in this manner that expansion processes are transferred into the oven brickwork.

Another improved variant of the coke oven lies in adapting the gas routing to the positioning of the gas space dividing walls. Thus, when the coking chamber is section-wise divided by the gas space dividing walls, at least one air feeder main for primary combustion air is led into each of these sections and one or two downcomers are led out from each of these sections.

An improved variant of the coke oven lies in that at least part of the interior walls of the coking chamber and/or part of the surfaces of the gas space dividing walls is configured as secondary gas heating surfaces by coating them with a high-emission coating (HEB), with the emission degree of this high-emission coating being equal to or greater than 0.9.

This HEB preferably consists of the substances $Cr_2O_3$ or $Fe_2O_3$ or of a mixture containing these substances, with the portion of $Fe_2O_3$ amounting to at least 25% by wt. in a mixture and with the portion of $Cr_2O_3$ amounting to at least 20% by wt. in a mixture. Alternatively, the HEB can also contain SiC with a portion of at least 20% by wt.

In an improved variant of this coke oven, the HEB furthermore contains one or more inorganic binding agents. It has also been found that the constituents of the HEB should have a special grain size which is smaller than or equal to 15 μm and which ideally ranges between 2.5 and 10 μm.

By way of the HEB, the radiation situation in the coke oven room is substantially improved and the fast coking process from top to bottom is further speeded up.

The coke oven can be further improved by coating the walls of flue gas channels extending horizontally underneath the coking chamber partly or entirely with HEB in any one of the material composition as described hereinabove, thus improving the indirect heat transport through the floor of the coke oven chamber.

Also covered by the present invention is a method for production of coke by implementing the coke oven described hereinabove, utilising one of the embodiments. In general, a multitude of the described coke ovens are then operated more or less in parallel.

According to a particularly suitable variant of the method it is provided that the temperature in the coking chamber during the coking process ideally amounts to 1,000 to 1,400° C. on average. This temperature may also be exceeded for a short period of time.

DETAILED DESCRIPTION OF THE INVENTION

Figure 1:
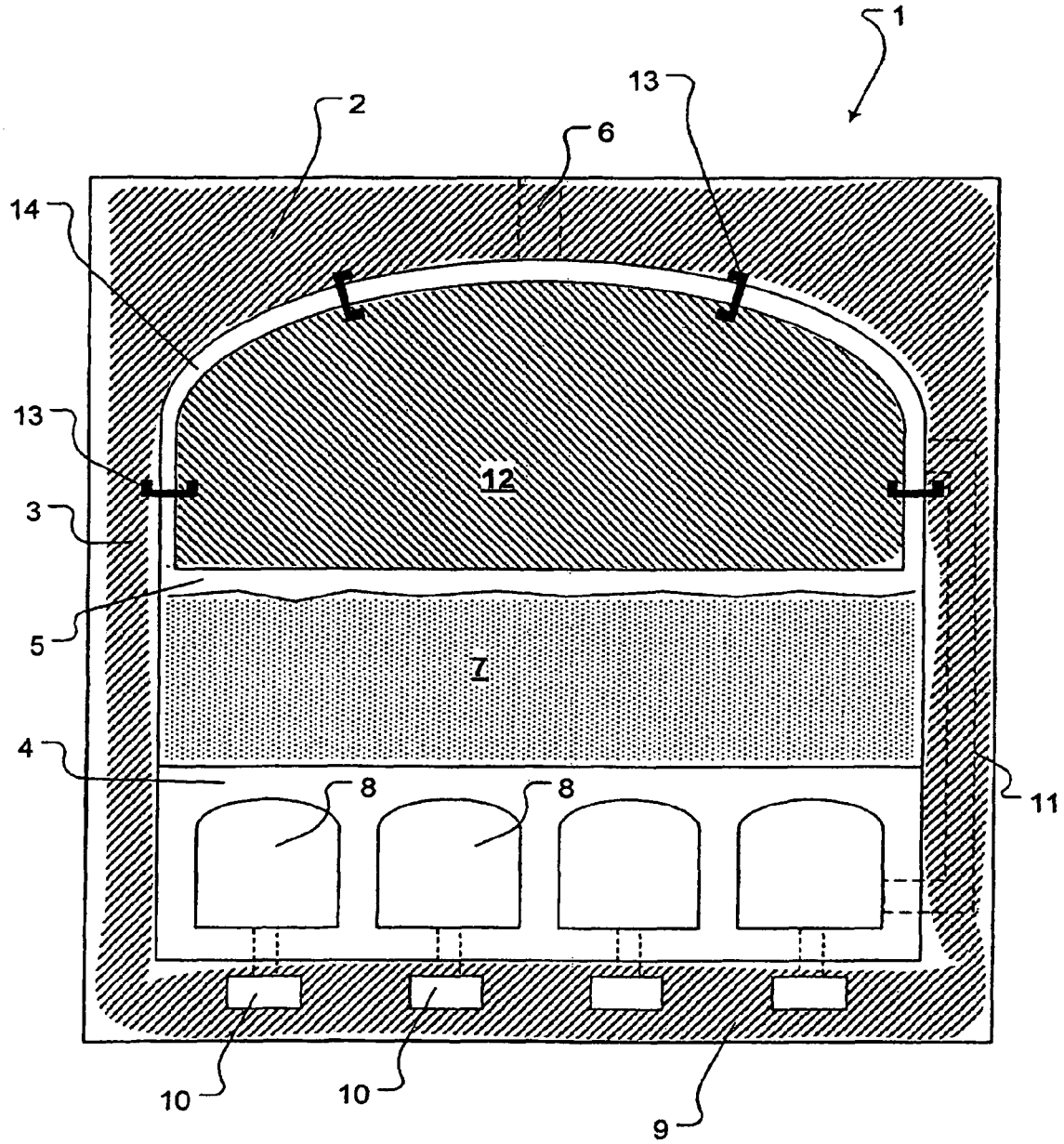
FIG. 1 shows a sectional view of a coke oven according to an embodiment of the present invention.

FIG. 1 shows the inventive coke oven in a sectional view. The coke oven 1 consists of an oven top 2, oven walls 3 and an oven floor 4, which enclose the oven room 5. The primary combustion air inlets 6 represented in dashed lines lead into the oven room 5. The coal charge 7 rests on the oven floor 4 and flue gas channels 8 extend underneath the oven floor 4. Also shown in the cross-section are the secondary combustion air inlets 10 provided in the oven foundation 9 which allow for conducting secondary air into the flue gas channels 8.

Through vertical downcomers 11, which extend in the oven walls 3 from the oven free space of the oven room 5 to the horizontal flue gas channels 8 underneath the oven floor 4, the gases developing during coal carbonisation can be discharged.

The interior surfaces of the oven room 5 are provided with an HEB that consists of $Cr_2O_3$, $Fe_2O_3$ and SiC in equal portions. This HEB of the interior walls, thereby becoming secondary heating surfaces, has not been shown here any further. Furthermore, gas space dividing walls 12, tertiary heating surfaces, are mounted in oven room 5 vertically and parallel to each other which, by and large, fill the free cross-section above the coal charge 7 and which are also coated with this HEB. The gas space dividing walls 12 are mounted to the holder elements 13 which in the case shown here have a shape of wall and roof anchors. In the example shown here, a small, circumferential gap 14 is left between the interior wall surfaces of the oven room 5, coal charge 7 and the outer edge of gas space dividing wall 12 in order to allow for a horizontal convection in the oven room 5 and to prevent damage to material due to differences in the expansion behaviour of the structural parts.

Figure 2:
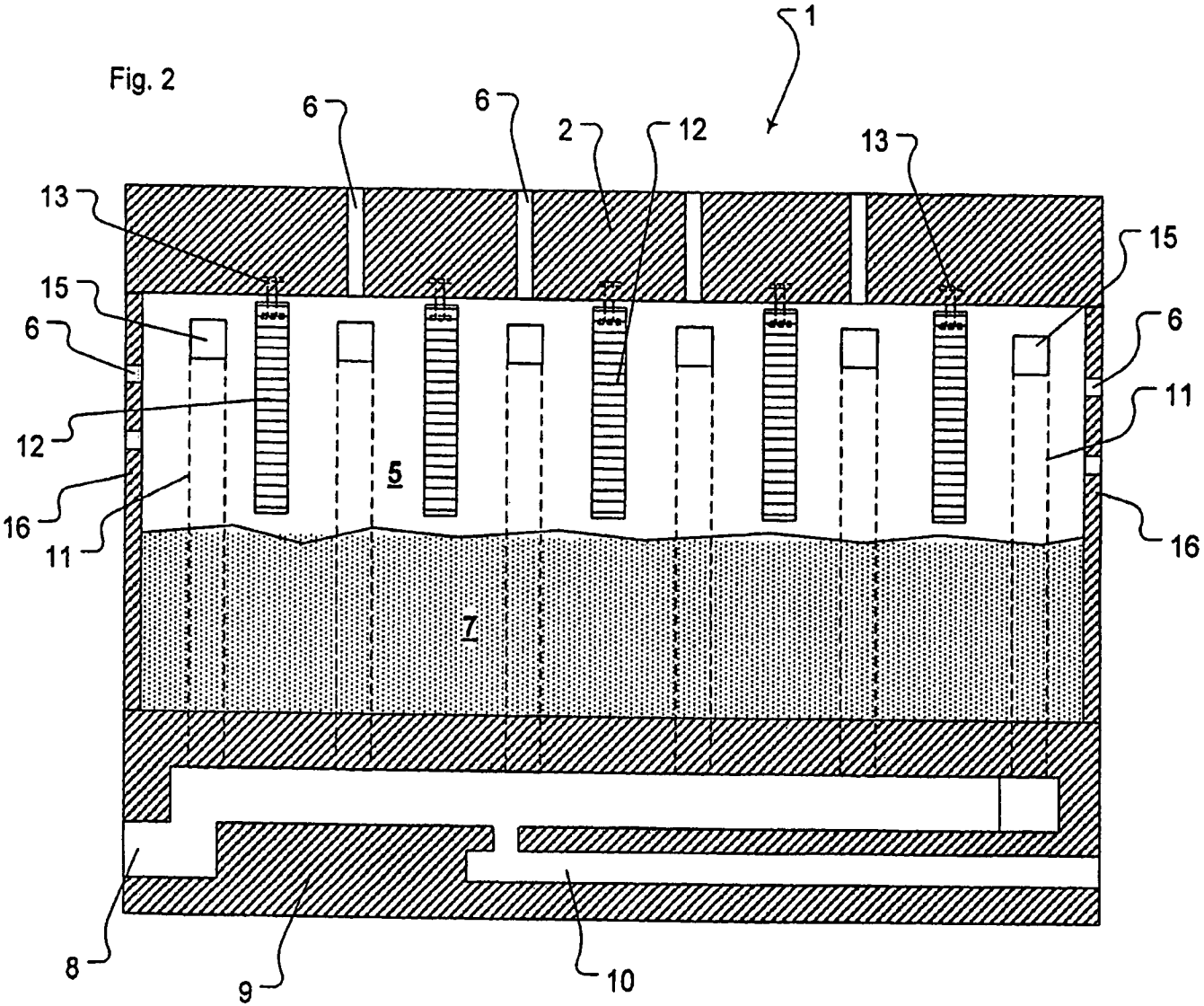
FIG. 2 shows another sectional view of a coke oven according to an embodiment of the present invention.

FIG. 2 shows the inventive coke oven 1 in another sectional view. The reference symbols of FIG. 1 apply analogously. What can be clearly seen is the division of the oven room 5 through gas space dividing walls 12 into six sections, with primary air feeder mains or combustion gas inlets 6 leading into each section and wherein gas can leave the oven room 5 again through openings 15 and flue gas channels 8 as well as downcomers 11. The introduction of primary combustion air into the oven sections which are adjacent to the oven door 16 is accomplished through primary combustion air inlets 6 which are provided in the oven door 16 proper. The gas routing elements 12 are mounted to the holder elements 13 which are provided in the oven top 2 and oven wall 3 for this purpose.

Figure 3:
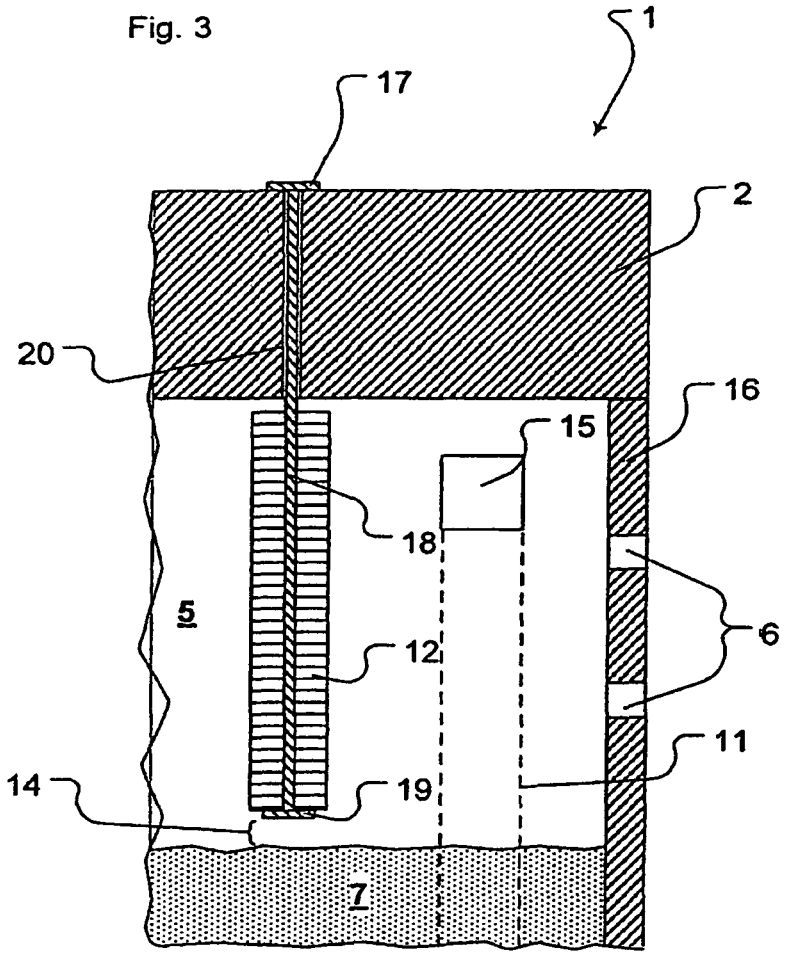
FIG. 3 shows another sectional view of a coke oven according to an embodiment of the present invention.

In a sectional view, FIG. 3 represents a special suspension for gas space dividing walls 12, showing the section of coke oven 1 which lies adjacent to the oven door 16. The gas space dividing wall 12 hanging in oven room 5 is spaced from coal charge 7 with a gap 14. The gas 12 is fastened through one or several holding elements in the oven top 2. This holding element mainly comprises a top plate 17, a pull bar 18 and a bottom plate 19. The pull bar 18 is plugged through a top opening 20 and is held by the top plate 17 which simultaneously closes the top opening 20 entirely. Furthermore, the pull bar is guided from the top to the bottom through the gas space dividing wall 12 and/or built-in into said gas space dividing wall. The main weight of gas element space dividing wall 12 rests on the bottom plate 19 of the holder element fastened to the bottom end of the pull bar 18.

By way of this division of the coke oven into various sections with a section-wise gas routing and by way of the homogenisation of radiation through the gas space dividing wall, it was managed to reduce coking time and to minimise losses of product in the area close to oven doors.

LIST OF REFERENCE NUMBERS

1 Coke oven
2 Oven top
3 Oven wall
4 Oven floor
5 Oven room
6 Primary Combustion Air Inlets
7 Coal charge
8 Flue gas channel
9 Oven foundation
10 Secondary Combustion Air Inlets
11 Downcomer
12 Gas space dividing wall
13 Holder element
14 Gap
15 Opening
16 Oven door
17 Top plate
18 Pull bar
19 Bottom plate
20 Top opening

The invention claimed is:

1. A method for the production of coke comprising the steps of:

using a coke oven of horizontal construction comprising at least one coking chamber, at least one primary combustion air inlet leading into the coking chamber, laterally arranged vertical downcomers as well as bottom flues with flue gas channels arranged horizontally and underneath the coking chamber for indirect reheating of the coking chamber and air feeder mains provided in the foundation for conducting air into the flue gas channels, and;

coking coal in the coking chamber by disposing a coal charge onto the oven floor and by conducting primary combustion air into the coking chamber, an oven free space is in the operation of the coke oven not destined for being filled with a charge of coal or other solid feed material for coking; and discharging the gases developing during the coal carbonization through the vertical downcomers which extend in the oven walls from the oven free space of the oven room to the horizontal flue gas channels; and conducting secondary combustion air into the air feeder mains for conducting air into the flue gas channel inlets provided in the oven foundation underneath the oven floor;

wherein, gas space dividing walls are arranged in the oven free space of the coking chamber vertically and parallel to each other, and by the gas space dividing walls a section-wise gas routing of the coking gas is achieved so that the gas routing is improved and a homogenization of radiation in the coking chamber is achieved, and at least one primary combustion air inlet directs primary air into each of these sections, and one or two downcomers lead out from each of these sections, so that the gas routing is adapted to the positioning of the gas space dividing walls.

2. A method according to claim 1, wherein coking is carried out at a mean oven room temperature of 1,000 to 1,400° C.

3. A coke oven of horizontal construction (non-recovery/heat recovery type) comprising at least one coking chamber, at least one primary combustion air inlet leading into the coking chamber, laterally arranged vertical downcomers as well as bottom flues with flue gas channels arranged horizontally and underneath the coking chamber for indirect reheating of said coking chamber and air feeder means provided in the oven foundation for conducting air into the flue gas channels, wherein one or more gas space dividing walls are arranged in the oven free space which in the intended operation of a coke oven is not destined for being filled with a charge of coal or other solid feed material for coking, so as to divide the oven free space of the coking chamber into sections, and at least one primary combustion air inlet directs primary air into each of these sections, and one or two downcomers lead out from each of these sections.

4. The coke oven according to claim 3, wherein the gas space dividing walls are shaped as hanging ribs or hanging walls, and that said gas space dividing walls have openings or a partly open structure.

5. The coke oven according to claim 3, wherein the gas space dividing walls can be detachably hung into suitable holders, with these holders being mounted in the wall and/or top of the coking chamber.

6. The coke oven according to claim 3, wherein at least part of the interior walls of the coking chamber and/or part of the surfaces of the gas space dividing walls is configured as secondary heating surfaces by coating them with a high-emission coating (HEB) comprising $Cr_2O_3$, $Fe_2O_3$ and mixtures thereof, such mixtures comprising >25 wt % $Fe_2O_3$ and >20 wt % $Cr_2O_3$.

7. The coke oven according to claim 6, wherein the HEB furthermore contains SiC with a portion of at least 20% by wt.

8. The coke oven according to claim 6, wherein the HEB furthermore contains one or more inorganic binding agents.

9. The coke oven according to claim 6, wherein the grain size of the HEB constituents is smaller than or equal to 15 μm.

10. The coke oven according to claim 6, wherein the walls of the flue gas channels extending horizontally underneath the coking chamber are partly or entirely coated with the high emission coating (HEB).

11. The coke oven according to claim 6, wherein the grain size of the HEB constituents is between 2.5 and 10 μm.

* * * * *